United States Patent [19]

Claxton et al.

[11] 3,984,234

[45] Oct. 5, 1976

[54] METHOD AND APPARATUS FOR CIRCULATING A MOLTEN MEDIA

[75] Inventors: Raymond Joffre Claxton; Joseph Raymond Herrick, both of Verona, Pa.

[73] Assignee: Aluminum Company of America, Pittsburgh, Pa.

[22] Filed: May 19, 1975

[21] Appl. No.: 578,762

[52] U.S. Cl. ..... 75/68 R; 75/65 R; 266/216; 266/235; 266/901; 415/200; 415/214

[51] Int. Cl.[2] ..... C22B 21/00

[58] Field of Search ..... 75/65 R, 68 R; 415/214, 415/200; 266/216, 235, 901

[56] References Cited

UNITED STATES PATENTS

| | | | |
|---|---|---|---|
| 1,513,875 | 11/1924 | Wilke | 75/65 R |
| 2,304,849 | 12/1942 | Ruthman | 415/200 |
| 2,528,210 | 10/1950 | Stewart | 415/214 UX |
| 2,948,524 | 8/1960 | Sweeney et al. | 415/214 UX |
| 3,010,402 | 11/1961 | King | 415/214 |
| 3,048,384 | 8/1962 | Sweeney et al. | 415/200 X |
| 3,092,030 | 6/1963 | Wunder | 415/214 X |
| 3,255,702 | 6/1966 | Gehrm | 415/214 UX |
| 3,291,473 | 12/1966 | Sweeney et al. | 415/200 |
| 3,836,280 | 9/1974 | Koch | 415/200 X |
| 3,873,305 | 3/1975 | Claxton et al. | 75/68 R |

*Primary Examiner*—M. J. Andrews

*Attorney, Agent, or Firm*—Andrew Alexander; Carl R. Lippert

[57] ABSTRACT

A method and apparatus for moving molten media such as molten metal or molten salt through a metal treating system utilizing a vaned disc immersed in the media and located in a cylindrical portion of an open-ended volute so as to provide above the disc a body of the media having an unconfined surface.

36 Claims, 4 Drawing Figures

METHOD AND APPARATUS FOR CIRCULATING A MOLTEN MEDIA

BACKGROUND OF THE INVENTION

This invention relates to molten media and in particular to a method and apparatus for quiescently moving or urging a molten media such as a molten metal or a molten salt through a system such as a scrap reclamation system wherein the molten media may be used to dissolve or melt metal scrap.

It is generally recognized that pumping or moving a high temperature molten media such as molten aluminum or a molten salt through any system or process normally requires expensive pump equipment because of the temperatures involved. Often the high expense associated with such pump equipment occurs because of the precision and close tolerances employed to prevent leaking of the molten media at the pump drive shaft and consequent binding upon solidification or freezing of the escaping molten media. A further reason for high cost pump equipment when molten aluminum is involved results from the selective material from which the pump must be fabricated to avoid the corrosion or erosion effects that molten aluminum has on various metals thus necessitating the use of refractory materials which are not only expensive but are less durable than metal.

Because of the close tolerances and refractory materials employed in many molten metal pumps, pump breakdowns occur with alarming regularity. Not only is the pump itself expensive to repair, but repairs require substantial time periods during which the system dependent on the pump must also be interrupted. This problem is particularly acute in recirculating systems for melting and reclamation of metal scrap. The recirculating system or process referred to is one which utilizes a hot molten melting media to melt the metal scrap. It includes a zone where heat is applied to a melting media and a melting bay to which the heated melting media is circulated to melt metal scrap, the melted scrap and melting media being then returned to the heating zone and molten metal removed at a rate commensurate with the charging rate. A pumping or circulating means is an essential component of any such system. If in such a system the pump jams, wedges or otherwise stops, the incoming cold metal scrap will quickly cause the melting media to freeze or solidify and consequently require a great deal of expense and labor to restart the process. Subsequent stations in the molten metal system such as metal degassing, purification, and ingot casting or other treatments are also interrupted such that the disruptive effect of a pump breakdown is obviously a serious problem in a molten metal system.

A further problem encountered in a recirculating molten aluminum process used to reclaim aluminum containers is the formation of skim. One form of skim referred to in recirculating molten aluminum processes is the oxide which aluminum in its molten state forms when it is exposed to air. Obviously, therefore, in this type of process no more surface area of molten aluminum should be exposed to the atmosphere than is necessary. For example, surface turbulence, cascading or vortexing of molten aluminum can themselves constitute a source of skim generation and often have to be kept to the lowest possible level. The oxide skim entrains unoxidized metal in substantial amounts as it rises from the metal melt to form a floating skim layer and this entrained metal further contributes to the melt loss associated with skim. The circulatory melting systems referred to above are especially sensitive to skim formation since floating skim acts as an insulator and substantially reduces the ability to heat the molten metal through its surface. The reduced heat input to the molten metal obviously reduces the melting capacity of the circulatory system, and in addition, equipment life tends to be shortened by absorbing heat rejected by the insulative oxide skim. Hence, an additional burden placed on any pumping means employed in such a system is that it should not aggravate the skim problem.

A system for moving molten media through an industrial process, i.e. a recirculating metal scrap reclamation process, has been discovered which solves all of these problems by being relatively inexpensive, easily and quickly repaired without requiring shutdown of the process, and relatively skim-free when used to recirculate molten aluminum in a process for reclaiming used aluminum containers such as food and beverage containers. Furthermore, this system is especially suited to existing level pour molten metal transfer systems which are widely used throughout the light metals industry, particularly the aluminum industry since aluminum in its molten state, as was mentioned earlier, is very reactive with oxygen.

OBJECTS OF THE INVENTION

An object of this invention is to provide an inexpensive, novel method and apparatus for quiescently urging a molten media through a treatment system.

An object of this invention is to provide a system for urging a molten melting media through a recirculating metal scrap reclamation process.

Yet a further object of this invention contemplates a novel combination of vaned disc in an open-ended volute or housing for quiescently urging molten melting media through a recirculating reclamation process.

Yet another object of this invention is to provide a novel system for quiescently urging molten metal through a used metal container reclamation process to melt used containers with minimal formation of skim.

Another object of this invention is to provide a novel system for circulating molten salts through a metal producing cell to replenish the molten salts in which the metal producing ore is dissolved.

Yet a further object of this invention is to provide a system for moving molten metal in a recirculating process, the system being capable of repair without shutdown of the process.

These, as well as other objectives, will become apparent from a reading of this disclosure and claims and an inspection of the accompanying drawings appended hereto.

SUMMARY OF THE INVENTION

This invention includes a novel method and apparatus for quiescently circulating or pumping a molten media by introducing or supplying the molten media to a housing having a substantially right cylindrical portion with a circumferentially slotted opening in the wall thereof, the slotted opening adapted to transferring the molten media from the housing. The molten media is urged or forced from the housing by action of a vaned disc located in the cylindrical portion and suited for rotation substantially about the axis thereof. The vaned disc is immersed in the molten media so as to provide above the disc a body of the media having an unconfined surface. The vaned disc is located such that the vanes sweep past portions of the slotted opening which action forces molten media against the disc and outwards through the slotted opening.

BRIEF DESCRIPTION OF THE DRAWINGS

In the description below, reference is made to the following drawings in which.

DETAILED DESCRIPTION OF THE DRAWINGS

Figure 1:
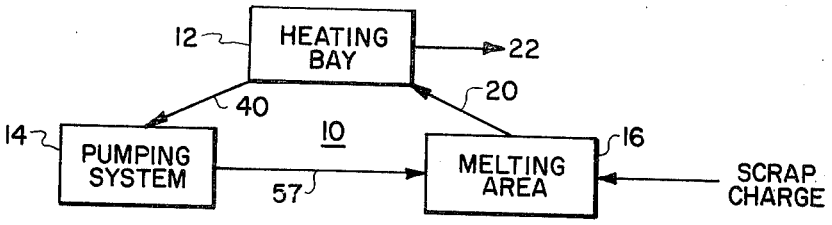
FIG. 1 is a plan view showing a general schematic of a circulatory melting system.

FIG. 1 is a schematic of a circulatory metal melting system 10 wherein the molten melting media is circulated from the heating bay 12 through line 40 by a pumping system 14 and then along line 57 to the melting bay 16, where scrap or other charge or feed is introduced, and then returned to the heating bay through line 20. Pumping system 14 recirculates the melting media at a rate sufficient to ensure complete and efficient melting of charge introduced to the melting bay. A product discharge line 22 exiting from the heating station 12 removes molten metal at a rate commensurate with the charging rate to the melting bay. The molten melting media may be heated in the heating bay by combustion units discharging their heat upon the upper surface of the liquid in the heating bay or by electric resistance heaters immersed in the molten media in the melting bay or by other suitable means. This is the type of arrangement described generally above as the circulatory system which offers high efficiencies with respect to heat utilization, melting rate, and low skim generation.

The system as shown in FIG. 1 is typically for operation with molten metal of similar composition to the charge such that the composition is controlled at all times. If molten salt (or some other substance) were employed as the melting media, a salt-metal separation would have to occur, usually by gravity with the molten metal settling, to facilitate removal of the melted charge.

In the heating chamber 12 the melting media is heated to a temperature significantly above the melting temperature of the scrap charge so as to, by depletion of sensible heat therefrom, provide the latent heat necessary to melt the charge. This can be referred to as superheating, that is, heating substantially above melting temperature such that substantial heat can be removed without solidification. When the molten media is aluminum, a suitable temperature leaving the heating bay is around 1400° to 1500°F. As temperatures exceed 1475°F, however, there is a tendency to form oxide in the heating bay and hence temperatures are preferably kept below 1475°F. A typical temperature exiting the heating bay might be 1400°F and a typical temperature exiting the charging bay or melting area in line 20 might be 1300°F. This type of system, as explained earlier, provides for very high efficiencies in heat utilization and melting rates provided molten media is made to flow quiescently and efficiently around the loop without substantial breakdown time or substantial skim formation.

Figure 2:
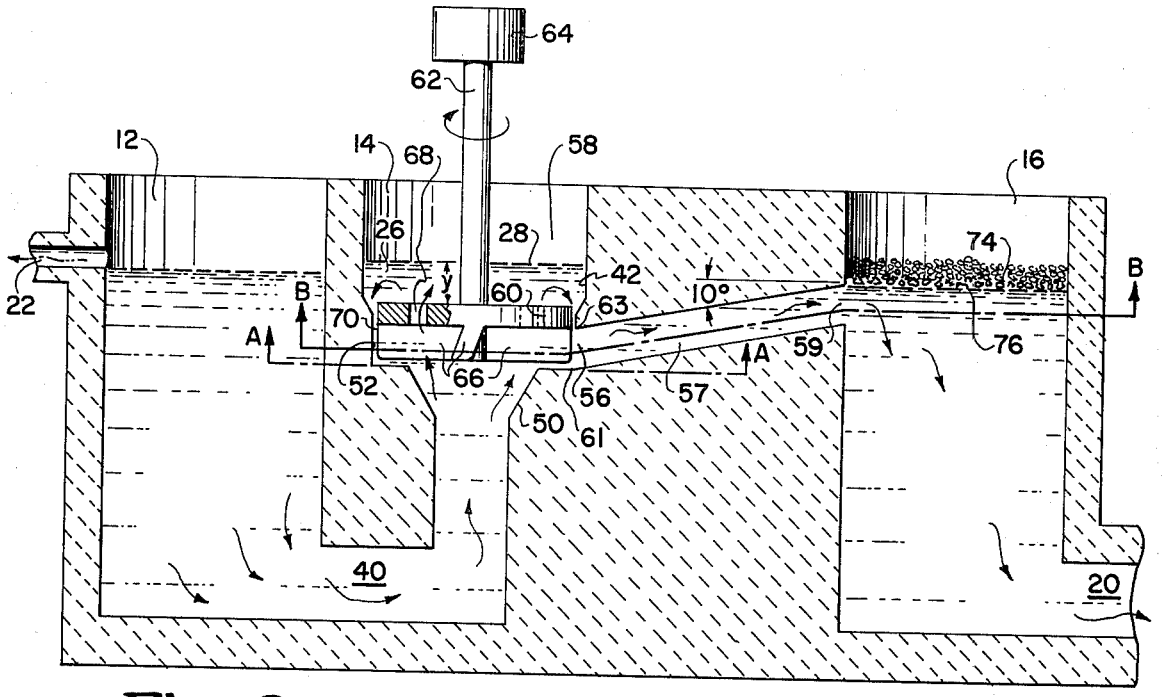
FIG. 2 is an elevation view in cross-section illustrating the improved system of a vaned disc in an open-ended housing and its cooperation with a heating bay and melting bay in a molten media melting system.

In accordance with this invention, referring to FIG. 2, there is shown an embodiment of the use of the improved pumping system, generally referred to as 14, for quiescently urging or propelling molten melting media through a circulatory system of the type just described in FIG. 1 or for other applications where metal movement is desired such as level pour molten metal transfer systems. Initially, it will be understood from an inspection of FIG. 2 that melting media provided in heating bay 12 will seek a similar level in pumping system 14 and melting bay 16. The pumping system 14 circulates or moves the molten media by drawing it from the heating bay 12 through channel 40 and forcing it out through channel 57 into the melting area 16. Return line 20 from the melting bay to the heating bay is only partially shown in FIG. 2. The pumping system 14 comprises a housing or volute generally referred to as 42 having a bottom portion 50 diverging upwardly from channel 40 into a substantially right cylindrical portion 52 meaning that it is typically within 10 degrees of the vertical. Housing 42 may have an end 58 open to the atmosphere as shown in FIG. 2. The cylindrical portion 52 has a circumferentially slotted opening 56 into channel 57 which is preferably located adjacent and just above the diverging portion 50. Within the cylindrical portion 52 is situated a disc 60 having radial vanes 66 extending downwardly therefrom. The disc 60 is rotated by shaft 62 driven by a driving means 64, suitably an electric or air motor. Preferably, the vanes 66 on disc 60 extend downwardly substantially through the depth of slotted opening 56 and preferably the disc 60 is situated in the cylindrical portion 52 just above the slotted opening 56 as shown in FIG. 2. However, it is to be understood that vanes 66 may not extend throughout the full depth of slotted opening 56 and disc 60 may be located substantially opposite the slotted opening 56 or some distance above it in the cylinder portion 52. In the former, the axial depth of disc and vane combination may be substantially equal to the depth of slotted opening 56.

It is important in the practice of this invention that the disc 60 be completely submerged in the molten media and furthermore it is important that disc 60 be submerged to a predetermined minimum depth indicated as the distance $y$ in FIG. 2 to provide a body 26 of the melting media above the disc, the body characterized by having an unconfined upper surface 28. If the disc is not submerged to the minimum depth $y$, the body of molten melting media in the cylindrical portion above the disc may be whipped into a vortex upon rotation of the disc. Vortexing, as explained earlier, in a system wherein the melting media is a readily oxidizable metal such as aluminum, can lead to the formation of undesirable skim and its attendant problems. Generally stated, the disc should be sufficiently submerged to prevent vortexing at the operational rate of rotation of the disc. For example, a disc 6 inches in diameter is preferably submerged 3 inches in the molten melting media when the rotation rate is 100 r.p.m. but may be submerged to a lesser extent if the rotation rate is slower. Conversely, if the rate of rotation is higher than 100 r.p.m. then the depth of submergence $y$ may be required to be greater than 3 inches. In the event that a disc having a diameter of 20 inches is required as is the case when a greater volume of molten media is to be recirculated, the disc should be submerged in the molten media in conduit 42 to a depth of 6 inches when the rate of rotation is 100 r.p.m. However, depending largely on the rate of rotation the depth to which the disc is submerged may be increased or decreased and the desired depth is readily determined for any given size and rotation condition.

It is preferred to avoid excessive disc submergence depth which can cause freezing of portions of the media in body 26 resulting in binding of shaft 62. For example, a disc 6 inches in diameter normally should not be submerged over 6 inches when the rate of rotation is 100 r.p.m. unless means for heating body 26 in housing 42 be provided in which case the maximum depth of submergence may be increased substantially.

To provide a larger margin between vortexing and freezing of body 26 of molten melting media in conduit 42 above the disc 60, a controlled flow pattern or circulation of molten melting media is established to provide a supply of hot molten media from heating bay 12 to the body 26. That is, molten melting media circulated in the housing above disc 60 provides heat there to prevent freezing and ensure, among other things, smooth, uninterrupted rotation of shaft 62. Preferably, passages 68 in disc 60 are provided to circulate the molten media above disc 60. The number and size of the passages 68 can be important. Passages too few in number or small in size may provide insufficient flow of molten melting media above the disc and increase the risk of freezing above the disc. Obviously, too many passages 68 may interfere with the disc's efficiency in that excessive energy is consumed in the recirculation function. It has been discovered that having four passages 68 in a disc permits sufficient flow of molten melting media to prevent freezing without interfering with the efficiency of the vaned disc. For example, four ½-inch cylindrical passages in a 6-inch diameter disc submerged to a depth of 3 inches, permits a controlled flow of molten melting media to the housing above the disc which prevents solidification without interfering with the pumping efficiency. As a further example, a 20-inch diameter disc may have four 1-inch diameter passages without affecting the integrity of the pumping system.

The diameter of the disc 60 and the diameter of the cylindrical portion 52 of the housing 14 adjacent the disc have an important relationship in order that the disc quiescently moves the molten media through the system with high efficiency. Preferably, the diameter of the cylindrical portion 52 of the housing 42 should be approximately 1 inch greater than the diameter of the vaned disc 60. That is, the annular space 70 between the circumferential wall 72 of the vaned disc 60 and the wall of the cylindrical portion 52 should be approximately ½ inch. The space 70 may be as large as 1½ inches or as small as ¼ inch. That is, the disc diameter may be ½ inch to 3 inches smaller than the diameter of the cylindrical portion. However, when the space 70 departs substantially from a ½ inch space, certain problems may arise which interfere with efficient movement of the molten melting media through the reclamation system. As space 70 is increased the force or pressure which moves the molten melting media through the slotted opening 56 is diminished. If space or annular gap 70 is substantially smaller than ½ inch, flow of molten media from body 26 may be restricted thus interrupting the flow pattern through passages 68 and recirculation via space 70, resulting in molten melting media in the portion above the vaned disc 60 solidifying due to reduced circulation through body 26.

A further point will serve to underline the importance of the size of space 70 between the disc and cylindrical portion. Since it is quite difficult to be completely free of skim, a small amount of skim may form at the unconfined surface 28 of the molten aluminum in the open-ended volute or housing 42. If space 70 is substantially smaller than ½ inch, this skim may collect and build up to bridge space 70 consequently stifling the return flow and as discussed above lead to total shutdown of the system. If bridging does not occur, particles of the skim may wedge in the space 70 severely damaging volute wall refractories requiring shutdown of the operation for repairs. While it is often preferable, expecially when employing a disc diameter not over 12 inches, that space 70 be maintained quite close to ½ inch, certain instances may occur though when departure therefrom is suitable and may even be advantageous, as may be true when a disc of quite large diameter is required. Then, the space 70 may be increased substantially. For instance, it may be desired to use a disc as large as 50 inches in diameter to provide the required flow rate in which case it will be seen the disc can be significantly spaced from the wall of the cylindrical portion. The small losses in pumping force occasioned by the larger gap 70 would be inconsequential in such a system.

As noted, a small amount of skim may form at the unconfined surface 28 and subsequently cause damage. This invention contemplates providing a layer of material such as a non-oxidizing gas or molten salt in housing 42 above the body 26 of molten melting media to prevent air or other reactive material which may form skim from contacting the molten melting media at surface 28. Preferably the layer should be a gas substantially non-oxidizing to the molten melting media. When the molten melting media is molten aluminum, suitable gases include the so-called inert gases helium, neon, argon, krypton, xenon, along with nitrogen, carbon dioxide, and mixtures of these gases. When a gas is employed, it is usually desirable to provide a shroud or closure (not shown) over open-end 58 of housing 42.

Another feature of the present pumping system includes rotation of disc 60 substantially about the axis of the cylindrical portion 52 by which rotation is meant that shaft 62 of the disc 60 does not have to be aligned exactly along the axial center of the cylindrical portion 52 but may be slightly off center within tolerances allowed by the magnitude of space 70. This feature alone cuts down the cost of producing this pumping system since the high cost involved in providing a precision fitting is obviated.

Figure 3:
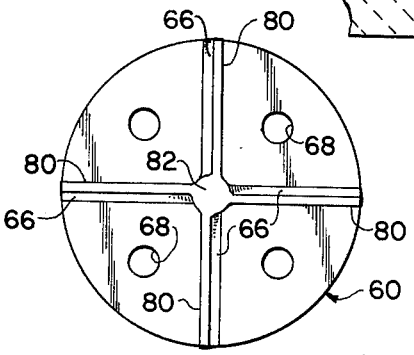
FIG. 3 is a plan view of the vaned disc from line A—A in FIG. 2.

Referring to FIG. 3, there is shown a preferred embodiment of disc 60. Vanes 66 in this preferred embodiment extend radially outward from a hub 82 to divide the disc into equal sections and are mounted or formed on the disc to provide an angle between the vane and the plane of the disc which is less than 90°. That is, preferably the vanes are canted to have a leading edge 80 in the direction of rotation so that rotation produces upward as well as outward flow. Generally, the angle between the vanes and disc depend to an extent on the depth of the vane and on the quantity of molten media to be circulated moved by the pumping system. For example, in a circulatory melting process the rate of recirculation of molten metal may be 500,000 lbs./hr. to accommodate a feed rate of 20,000 lbs./hr. of scrap. To provide this molten metal flow rate a 20 inch diameter disc with 4 inch deep vanes or blades projecting downwardly and canted forward in the direction of rotation to make an angle of 70° with the plane of the disc and rotating at 100 r.p.m. has been found satisfactory. For purposes of this example, the 4 inch vanes should preferably extend close to lower edge 61 of slotted opening 56 from just above the upper edge 63, FIG. 2. The vaned disc as just described provides a very efficient system for quiescently recirculating the molten melting media. But, variations from this example are also effective. For instance, the number of vanes can be increased or decreased and the angle the vanes make with the plane of the disc can be changed. The important feature is that the vanes should have a surface portion which may be canted, which surface in response to rotation of the disc moves the melting media upwardly and outwardly through the slotted opening.

One of the problems that has plagued numerous systems, especially pumps, used to move molten materials in industrial processes is the time required in repairing the pump. This problem is particularly acute with a recirculating system for metal scrap reclamation in that if an object jams, wedges, or otherwise stops the pump, the incoming cold scrap will quickly freeze the melting media. This problem has been solved in the present system. The vaned disc is easily withdrawn upwardly through opening 58 by any one of well-known systems for that purpose and the shaft and vaned disc replaced and then re-immersed in a few minutes to continue operation with only a very small chance of the molten metal solidifying. To facilitate withdrawal and therefore repair, by referring back to FIG. 2, it is noted that housing 42 may diverge outwardly above the cylindrical portion in which the disc rotates. Thus, a very important feature of this system is the ease and speed of repair.

Figure 4:
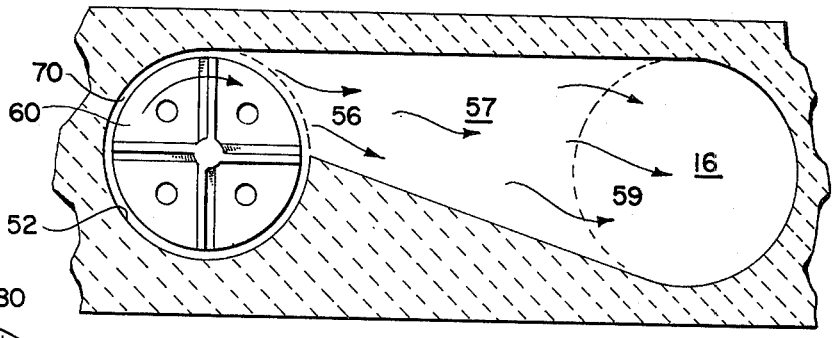
FIG. 4 is a plan view partly in cross-section taken along the line B—B of FIG. 2.

In a metal scrap reclamation system, a major concern is continuous flow of molten melting media directed to the incoming metal scrap to ensure continuous melting without freezing at the scrap-melting interface. It is desirable to have the flow of the molten melting media directed into the melting bay in such a way as to apply as much of the available heat as effectively as possible to the mass of scrap being introduced or submerged into the melting bay. Accordingly, by reference to FIG. 4, it is seen that pumping system 14 incorporates as one of its embodiments conduit 57 having as an inlet, slotted opening 56 in cylindrical portion 52 of the pump housing 42, and as an outlet an opening 59 substantially commensurate in extent with that of the melting area. Conduit 57 thus introduces a flow of molten melting media effectively across the full extent of melting bay 16.

An important feature of conduit 57 is slotted opening 56 in the wall of the cylindrical portion which has been referred to above in connection with the vaned disc. With respect to channel 57, slotted opening 56 preferably circumscribes an arc of approximately one-quarter of the circumference of cylindrical portion 52. An arc size substantially less than one-quarter may lead to restricted flow of molten melting media and consequently lower efficiency in transport, and an arc size substantially larger than one-quarter may result in sluggish movement of the molten media through conduit 57. In general the slot may describe an arc of about 70° to 120°. Another important feature of conduit 57 is that it diverges outwardly from the circumferential slotted opening 56 to the melting bay 16 to provide a sheet of smooth flow of sufficient breadth to encompass substantially the full width of the melting bay 16 to provide the hottest possible molten melting media to the lower portion of the mass of scrap 74 (FIG. 2) entering melting bay 16. It should be understood that channel 57 may be of uniform cross-section from cylindrical portion 42 to the melting area 16. But, in the case where the extent of the channel 57 crosswise to the flow direction is different that the extent of the melting area, the conduit may not provide flow of the molten melting media to all points of the lower portion of the mass of scrap entering the melting bay 16 and thus, cold spots may develop and cause portions of the melting area to become inoperative, thereby restricting the capacity of the process. Also, it is within the purview of this invention to have a conduit 57 with uniform cross-section equal in extent with the extent of the melting area; however, it will be appreciated that in certain instances this may not be desirable due to the size of disc and conduit required and the difficulty encountered in preventing solidification in housing 42. In addition to the above features, conduit 57 preferably is elevated from the circumferential slotted opening of inlet 56 to the discharge point or slotted opening 59. When conduit 57 is elevated, the hottest melting media is impinged into and directed to sweep across the entire entering bottom or lower portion 76 of the mass of scrap 74. Conduit 57 may be elevated upwardly, as shown in FIG. 2, from the horizontal at up to 25° with a preferred angle being in the range of 5 to 15°.

Materials of construction for the heating bay, housing for the vaned disc, and melting bay may be refractories resistant to degradation by molten aluminum or molten salt or the particular media involved. It is to be noted that no special material is required for the housing for the vaned disc. The shaft and vaned disc may be fabricated from material resistant to the molten media. For example, when the molten media is aluminum, the shaft and vaned disc may be made as an integral unit from graphite which lends itself to easy machinability. The shaft and vaned disc may be fabricated as a unit by casting using a castable material resistant to the molten media. After casting, no special machining is required before using.

While the pumping system has been described mainly with reference to a recirculating reclamation process, it should be understood that its application is not necessarily intended to be limited thereto. For example, the pumping system is suitable for circulating molten salts, such as cryolite, to an electrolytic cell used for the production of aluminum, for example, a Hall cell. The cryolite can be circulated from the electrolytic cell to a station where its concentration is replenished and then back to the cell. In this manner of operation, the concentration of cryolite within the cell is kept more uniform, thus providing higher current efficiencies.

This pumping system is also useful for circulating molten aluminum in the so-called open-hearth furnace. Circulation of molten aluminum in this furnace is advantageous in that it provides a generally uniform temperature throughout the depth of the molten metal within the furnace. Thus, a substantial savings in energy results when the molten aluminum is heated as by combustion units discharging their heat on the upper surface of molten aluminum in the furnace because heat transfer is no longer dependent only on conduction through the melt. Also, the molten aluminum may be treated, for example, to remove skim as molten aluminum is circulated from the relatively hot surface area to relatively cold bottom area within the furnace. Thus, in its broadest sense the invention should be suited to any system involving the transport of molten media where high pumping head is not a major consideration. For instance, in the aluminum industry the level pour systems, widely used because of their inherent low skim generation features, are sometimes in need of some molten media propulsion means and the invention offers such a means at a minimum of cost but at a high level of reliability.

While the invention has been described in terms of preferred embodiments, the claims appended hereto are intended to encompass all embodiments which fall within the spirit of the invention.

Having thus described the invention and certain embodiments thereof, what is claimed is:

1. A method for pumping a molten media comprising the steps of:

a. providing said molten media in a housing having a substantially right cylindrical portion with a circumferentially slotted opening therein for transferring molten media from said housing; and b. impelling said molten media from said housing through said slotted opening by action of a disc located in said cylindrical portion and rotating substantially about the axis thereof, said disc immersed in said molten media to provide thereabove a body of said molten media having an unconfined surface, said disc having downwardly extending vanes thereon that sweep past at least a portion of said slotted opening and force the molten media outward through said slotted opening.

2. A pumping system for a molten media comprising:

a. a housing for receiving molten media, said housing having a cylindrical portion with a cirumferentially slotted opening therein for transferring molten media from said housing; and b. a disc positioned in said cylindrical portion to provide thereabove a space in said housing for a body of said melting media such that said body has an unconfined surface, said disc adapted for rotation substantially about the axis of said cylindrical portion and having vanes extending downwardly therefrom arranged for sweeping past portions of said slotted opening, said vanes adapted for forcing the molten media against said disc and outward through said slotted opening.

3. A method for quiescently transferring a molten melting media from a heating bay to a melting area in a recirculating metal melting system comprising the steps of:

a. moving said molten media from said heating bay and upwardly through an inlet to a housing having a substantially right cylindrical portion with a circumferentially slotted opening therein, said slotted opening located above said inlet; and b. impelling said molten media from said housing through said slotted opening by action of a disc located in said cylindrical portion and rotating substantially about the axis thereof, said disc immersed in said melting media to provide thereabove a body of said melting media having an unconfined surface, said disc having downwardly extending vanes that sweep past a portion of said slotted opening and force the molten media against said disc and outward through said slotted opening.

4. A pumping system for quiescently transferring a molten melting media from a heating bay to a melting bay in a metal melting process comprising:

a. a housing having, i. an inlet to introduce molten melting media to said housing, ii. a substantially right cylindrical portion, and iii. a circumferentially slotted opening in said cylindrical portion located above said inlet, said slotted opening adapted for passing molten melting media from said housing; and b. a disc located in said cylindrical portion arranged to provide thereabove a space in said housing for a body of said melting media such that said body has an unconfined surface, said disc adapted for rotation substantially about the axis of said cylindrical portion and having vanes extending downwardly and arranged for sweeping past portions of said slotted opening, said vanes adapted for forcing the molten media against said disc and outward through said slotted opening.

5. The method of claim 3 including forcing said molten media through an outwardly diverging conduit having an outlet which discharges into said melting bay, the outlet commensurate in extent with extent of the melting bay to facilitate sweeping the molten media across the melting bay, the outlet further positioned to apply the melting media near the molten metal surface of the melting bay.

6. A pumping system of claim 4 including a conduit for carrying said molten melting media from said housing to said melting bay, said conduit diverging outwardly from said slotted opening to an outlet in said melting area, said outlet commensurate in extent with the extent of said melting bay to facilitate sweeping the molten media across the melting bay, the outlet further being positioned to apply the melting media near the surface of the melting bay.

7. A pumping system according to claim 6 wherein said conduit is elevated at an angle in a range of 5° to 15° from said slotted opening in said cylindrical portion to said outlet in said melting bay.

8. The pumping system according to claim 7 wherein the angle of elevation is 10°.

9. The method according to claim 1 wherein the housing is substantially vertical and open-ended to the atmosphere.

10. The method according to claim 1 wherein said disc is immersed sufficiently in said melting media to substantially prevent vortexing of said body of melting media in said housing above said disc upon rotation of said disc.

11. The method according to claim 10 wherein said body of molten melting media above said disc is kept molten by providing heat thereto.

12. The method according to claim 11 wherein the body of molten melting media is kept molten by circulating melting media thereto through a passage in said disc.

13. A system according to claim 2 wherein said housing is substantially vertical.

14. A system according to claim 13 wherein said conduit is open-ended.

15. A system according to claim 13 wherein said housing above said disc has a cross-section at least equal to the cross-section of said disc.

16. A system according to claim 2 wherein said disc has a passage therethrough from the vane side to the body of melting media.

17. A system according to claim 2 wherein said disc diameter is in a range of ½ to 3 in. less than the diameter of said cylindrical portion.

18. A system according to claim 2 wherein said disc is located above said circumferential slotted opening and said vanes on said disc extend downwardly across said slotted opening.

19. The system according to claim 2 wherein the disc has four vanes projecting radially to substantially divide the disc into quadrants.

20. The system according to claim 19 wherein said vanes have a canted surface portion which in response to rotation of said disc move said melting media upwardly and outwardly.

21. The method according to claim 3 wherein said body has a depth such that vortexing of said body of melting media does not occur on rotation of said disc.

22. The method according to claim 21 including circulating molten melting media to the body of molten melting media above said disc to prevent solidification of said body.

23. The method according to claim 22 wherein said melting media is circulated through a passage in said disc.

24. A method for quiescently transferring a molten melting media from heating bay to a melting area in a metal melting system comprising the steps of:

a. introducing said molten melting media from said heating bay to a substantially vertical housing having:
   i. an inlet for introducing said molten melting media to said housing,
   ii. a cylindrical portion, and
   iii. a circumferentially slotted opening in said cylindrical portion for transferring said melting media from said housing and said inlet located below said slotted opening;
b. impelling said molten media from said housing through said slotted opening by action of a disc located in said cylindrical portion and rotating substantially about the axis thereof, said disc immersed in said melting media to provide thereabove a body of said melting media having an unconfined surface, said disc having downwardly extending vanes thereon that sweep past a portion of said slotted opening and force the molten melting media against the disc and outward through said slotted opening; and
c. simultaneous with said impelling, circulating molten melting media through said disc to said body above said disc.

25. A pumping system according to claim 4 wherein said housing has a circular cross-section throughout its height having a diameter at least equal to the diameter of said disc.

26. A pumping system according to claim 4 wherein said disc has a passage therethrough from the vane side to the body of melting media.

27. A pumping system according to claim 26 wherein said disc diameter is in a range of ½ to 3 in. less than the diameter of said cylindrical portion.

28. A pumping system according to claim 4 wherein said disc is located above said slotted opening and said vanes on said disc project downwardly across said slotted opening.

29. The pumping system according to claim 4 wherein said disc has four vanes extending radially to substantially divide said disc into quadrants.

30. The pumping system according to claim 29 wherein said vanes have a canted surface portion which in response to rotation of said disc move said melting media upwardly and outwardly.

31. A pumping system for quiescently transferring a molten melting media from a heating bay to a melting bay in a metal melting process comprising:

a. a housing having:
   i. an inlet to provide molten melting media to said housing,
   ii. a substantially right cylindrical portion,
   iii. an open-ended top portion, and
   iv. a circumferentially slotted opening in said cylindrical portion located above said inlet, said slotted opening having an included arc in a range about 70° to 120° and adapted for passing molten melting media from said housing;
b. a disc positioned in said cylindrical portion to provide thereabove a space in said housing for a body of said melting media such that said body has an unconfined surface, said disc adapted for rotation substantially about the axis of said cylindrical portion and having:
   i. a diameter in a range of ½ to 3 inches less than said cylindrical portion,
   ii. a location in said cylindrical portion above said slotted opening, and
   iii. four vanes thereon extending downwardly and projecting radially outwardly dividing said disc into quadrants, said vanes having a canted surface portion which in response to rotation of said disc moves said melting media upwardly and outwardly; and
c. a passage through said disc to circulate molten melting media to the body above said disc.

32. The method according to claim 5 including circulating a portion of said molten melting media through a passage in said disc to said body above said disc, simultaneous with impelling said molten melting media from said housing.

33. A method for quiescently flowing a molten melting media from a heating bay to a melting bay for metal scrap in a recirculating metal melting process comprising the steps of:

a. introducing said molten media from said heating bay through a conduit to a housing having a cylindrical portion with a circumferentially slotted opening therein for discharging said molten media from said housing;
b. impelling said molten media from said housing through said slotted opening by action of a disk positioned in said cylindrical portion and rotating substantially about the axis thereof, said disc immersed in said melting media providing thereabove a body of said melting media having an unconfined surface, said disc having downwardly extending vanes that sweep past at least a portion of said slotted opening and force the molten media outwards through said slotted opening and through an outwardly diverging conduit having an outlet which discharges into said melting bay, the outlet commensurate in extent with extent of the melting bay to facilitate sweeping the molten media across the melting bay, the outlet further positioned to apply the melting media near the molten metal surface of the melting bay; and c. simultaneously with said impelling step, circulating said melting media through a passage in said disc to the body above said disc.

34. The pumping system of claim 31 including a conduit for carrying said molten melting media from said housing to said melting bay, said conduit diverging outwardly and sloping upwardly at an angle of 10° from said slotted opening to an outlet in said melting bay commensurate in extent with the extent of said melting bay, said outlet positioned to apply said melting media near the surface of said melting media in said melting bay.

35. The method according to claim 3 including, providing a layer of material selected from the group consisting of non-oxidizing gas and salt in said housing above said body of said melting media.

36. The method according to claim 35 wherein said layer includes a gas selected from the group consisting of helium, neon, argon, krypton, xenon, nitrogen, and carbon dioxide.

* * * * *